US010253735B2

(12) United States Patent
Naruoka et al.

(10) Patent No.: US 10,253,735 B2
(45) Date of Patent: Apr. 9, 2019

(54) SUPERCHARGER FOR SADDLE-RIDING VEHICLE

(71) Applicant: Kawasaki Jukogyo Kabushiki Kaisha, Hyogo (JP)

(72) Inventors: Shohei Naruoka, Kakogawa (JP); Hisatoyo Arima, Himeji (JP); Hiroyuki Watanabe, Kobe (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 253 days.

(21) Appl. No.: 14/740,155

(22) Filed: Jun. 15, 2015

(65) Prior Publication Data

US 2015/0275745 A1 Oct. 1, 2015

Related U.S. Application Data

(63) Continuation of application No. PCT/JP2013/080514, filed on Nov. 12, 2013.

(30) Foreign Application Priority Data

Dec. 17, 2012 (JP) ..... 2012-274478

(51) Int. Cl.
*F02M 35/16* (2006.01)
*F02B 39/00* (2006.01)
(Continued)

(52) U.S. Cl.
CPC ..... *F02M 35/162* (2013.01); *F01M 13/00* (2013.01); *F01M 13/0033* (2013.01);
(Continued)

(58) Field of Classification Search
CPC .... F01M 13/00; F01M 13/0033; F01M 13/04; F01M 2013/0038; F01M 2013/027;
(Continued)

(56) References Cited

U.S. PATENT DOCUMENTS 2,406,388 A * 8/1946 Larrecq ..... F02C 6/12 184/6.12
7,086,833 B2 8/2006 Cvjeticanin et al.
(Continued)

FOREIGN PATENT DOCUMENTS

CN 101892994 11/2010
CN 102242735 11/2011
(Continued)

OTHER PUBLICATIONS

PCT Application No. PCT/JP2013/0080514 International Preliminary Report on Patentability dated Jun. 23, 2015, 8 pages.
(Continued)

*Primary Examiner* — Mark A Laurenzi
*Assistant Examiner* — Paul Thiede

(57) ABSTRACT

A motorcycle supercharger (42) pressurizes intake air (I) for a combustion engine (E). The supercharger (42) includes a centrifugal impeller (50) and an impeller casing (52) which covers the impeller (50). The impeller casing (52) includes an outer peripheral wall (84) located radially outward of the impeller (50) and a side wall (86) located axially outward of the impeller (50). Reinforcing first and second side wall ribs (94, 96) are provided at the side wall (86) of the impeller casing (52).

18 Claims, 5 Drawing Sheets

(51) Int. Cl.

| | |
|---|---|
| ***F02B 39/04*** | (2006.01) |
| ***F01M 13/00*** | (2006.01) |
| ***F01M 13/04*** | (2006.01) |
| ***F02F 7/00*** | (2006.01) |
| ***F02B 33/40*** | (2006.01) |
| ***F04D 17/10*** | (2006.01) |
| ***F02B 33/44*** | (2006.01) |
| ***F01M 13/02*** | (2006.01) |
| ***F02M 35/02*** | (2006.01) |
| ***F02M 35/04*** | (2006.01) |
| ***F02M 35/10*** | (2006.01) |

(52) U.S. Cl.
CPC ..... *F01M 13/022* (2013.01); *F01M 13/04* (2013.01); *F02B 33/40* (2013.01); *F02B 33/44* (2013.01); *F02B 39/00* (2013.01); *F02B 39/04* (2013.01); *F02F 7/00* (2013.01); *F04D 17/10* (2013.01); *F01M 2013/0038* (2013.01); *F01M 2013/027* (2013.01); *F01M 2013/0477* (2013.01); *F02M 35/0204* (2013.01); *F02M 35/04* (2013.01); *F02M 35/10157* (2013.01); *F02M 35/10209* (2013.01); *F02M 35/10255* (2013.01); *F02M 35/16* (2013.01)

(58) Field of Classification Search
CPC . F01M 2013/0477; F02B 33/40; F02B 33/44; F02B 39/00; F02B 39/04; F02F 7/00; F02M 35/0204; F02M 35/04; F02M 35/10157; F02M 35/10209; F02M 35/10255; F02M 35/16; F02M 35/162; F04D 17/10
USPC ..... 123/559.1; 184/6.12
See application file for complete search history.

(56) References Cited

U.S. PATENT DOCUMENTS

| | | | | |
|---|---|---|---|---|
| 2004/0223847 | A1 | 11/2004 | Cvjeticanin et al. | |
| 2012/0267182 | A1* | 10/2012 | Saeki ..... | B62K 19/30 180/219 |

FOREIGN PATENT DOCUMENTS

| | | |
|---|---|---|
| DE | 102007055617 | 5/2009 |
| FR | 2853021 | 10/2004 |
| JP | 61-197236 | 12/1986 |
| JP | 62-010205 | 1/1987 |
| JP | 02-163539 | 6/1990 |
| JP | 05-058899 | 8/1993 |
| JP | 08-312361 | 8/1993 |
| JP | 5-58899 | 9/1993 |
| JP | 08-312361 | 11/1996 |
| JP | 2006-501393 | 1/2006 |
| JP | 2008-202467 | 9/2008 |
| JP | 2010-501775 | 1/2010 |
| JP | 2010-270748 | 12/2010 |
| JP | 2011-241833 | 12/2011 |
| JP | 2012-057592 | 3/2012 |
| WO | 2004/029418 | 4/2004 |

OTHER PUBLICATIONS

Extended and Supplementary Search Report dated Oct. 4, 2016 for Corresponding European Patent Application No. 13865820.8 (6 pages).

First Office Action dated Dec. 2, 2016 for Corresponding Chinese Patent Application No. 201380065473.3 with English language translation of the Search Report attached to the Office Action (7 pages).

PCT Application No. PCT/JP2013/0080512 International Preliminary Report on Patentability dated Jun. 23, 2015, 8 pages.

PCT/JP2013/080514 International Search Report dated Jan. 21, 2014, 2 pages.

Decision of Rejection dated Nov. 21, 2017 for Corresponding Japanese Patent Application No. 2014-553018 with English language Summary (4 pages).

Second Office Action dated Aug. 14, 2017 for Corresponding Chinese Patent Application No. 201380065473.3 with English language Summary (5 pages).

Notification of Reason(s) for Rejection dated Jul. 11, 2017 for Corresponding Japanese Patent Application No. 2014-553018 with English language Summary (4 pages).

* cited by examiner

SUPERCHARGER FOR SADDLE-RIDING VEHICLE

CROSS REFERENCE TO THE RELATED APPLICATION

This application is a continuation application, under 35 U.S.C § 111(a) of international application No. PCT/JP2013/080514, filed Nov. 12, 2013, which claims priority to Japanese patent application No. 2012-274478, filed Dec. 17, 2012, the entire disclosure of which is herein incorporated by reference as a part of this application.

BACKGROUND OF THE INVENTION

Field of the Invention

The present invention relates to a supercharger for a combustion engine mounted on a saddle-riding type vehicle such as a motorcycle.

Description of Related Art

A combustion engine mounted on a saddle-riding type vehicle such as a motorcycle has been known in which a supercharger pressurizes outside air and supplies the outside air to the combustion engine (e.g., Patent Document 1). The supercharger includes an impeller which pressurizes intake air and a casing which covers the impeller. As a merit in providing such a supercharger, the intake efficiency of sucking intake air is increased, thereby increasing output of the combustion engine.

RELATED DOCUMENT

Patent Document

[Patent Document 1] JP Laid-open Patent Publication No. H02-163539

SUMMARY OF THE INVENTION

Since the supercharger rotates at a high speed, for example, if the impeller is broken, there is the possibility that a broken piece of the impeller collides against a wall of the casing to break the wall of the casing. If the thickness of the wall of the casing is increased in order to prevent such breakage, it is not preferable since the size and the weight of the supercharger are increased.

In view of the above problem, an object of the present invention is to provide a supercharger for a combustion engine of a saddle-riding type vehicle which supercharger is able to prevent breakage of a wall of a casing without causing an increase in the weight of the casing.

In order to achieve the above-described object, a supercharger of the present invention pressurizes intake air for a combustion engine of a saddle-riding type vehicle, and includes: a centrifugal impeller; a casing including an outer peripheral wall located radially outward of the impeller and a side wall located axially outward of the impeller, the casing covering the impeller; and a side wall rib provided at the side wall of the casing. Here, "radially or radial direction" and "axially or axial direction" refer to a radial direction and an axial direction of a rotation shaft of the supercharger.

During rotation of the supercharger at a high speed, the impeller may be broken. Due to a centrifugal force, broken pieces or the like of the impeller collide against the casing which faces the radially outer side of the impeller. The inventors have found that, not a collision portion of the casing against which the broken pieces collide is broken, but a portion of the casing other than the collision portion is broken. Specifically, the inventors have found that the direction of a force caused at the time of collision is changed from a collision direction and the force is transmitted from the collision portion to the portion other than the collision portion of the casing. According to the above configuration, since the side wall rib is provided at the side wall of the casing, even if a force caused at the time of collision is transmitted from the collision portion of the casing in a direction different from the collision direction, it is possible to effectively prevent breakage of the casing. In addition, since merely the side wall rib is provided, an increase in the weight of the casing is not caused.

In the present invention, the side wall rib preferably extends in a radial direction. According to this configuration, even if a force caused at the time of collision is transmitted from the collision portion of the casing in a direction different from the radial direction, it is possible to extend, in the radial direction, a portion of the side wall which portion has a high axial strength, and it is possible to effectively prevent radial deformation of the side wall. In this case, the side wall rib preferably extends from a radially inner portion of the side wall to a radially outer portion of the side wall. According to this configuration, it is possible to extend, over the entire area in the radial direction, the portion of the side wall which portion has a high axial strength, and it is possible to further effectively prevent radial deformation of the side wall.

In the present invention, the supercharger preferably includes an outer peripheral wall rib formed at an outer peripheral portion of the casing. Here, the "outer peripheral portion of the casing" includes both an outer peripheral wall of the casing and a radially outer portion of the side wall of the casing. According to this configuration, a force from the collision portion of the casing, caused at the time of collision, is received by the outer peripheral wall rib, and thus it is possible to prevent breakage of the outer peripheral wall of the casing. In addition, even if the direction of the force caused at the time of collision is changed to the axial direction due to the force caused at the time of collision being received by the outer peripheral wall rib, the side wall rib is formed also at the side wall as described above, and therefore, it is possible to prevent breakage of the side wall of the casing.

In the case where the outer peripheral wall rib is included, the side wall rib preferably extends so as to be connected to the outer peripheral wall rib. According to this configuration, since a force caused at the time of collision is received by the side wall rib and the outer peripheral wall rib, it is possible to further effectively prevent breakage of the side wall of the casing.

In the case where the outer peripheral wall rib is included, preferably, a plurality of the outer peripheral wall ribs are formed so as to project radially outward from the outer peripheral wall of the casing and are provided so as to be spaced apart from each other in a circumferential direction. According to this configuration, since the plurality of the outer peripheral wall ribs are provided so as to be spaced apart from each other, it is possible to further prevent breakage of the casing. In addition, the radial thickness of the casing is reduced at a portion where no outer peripheral wall rib is provided, and thus it is possible to reduce the weight of the casing.

In the case where the outer peripheral wall rib is included, the outer peripheral wall rib preferably forms an outer mounting portion which connects the casing and another member. Since the outer mounting portion also serves as a reinforcing member as described above, it is possible to effectively prevent breakage of the casing while the weight of the casing is reduced.

In the case where the outer peripheral wall rib is included, the outer peripheral wall rib preferably includes: an outer mounting portion which connects the casing and a member other than the casing; and a reinforcing outer rib disposed at a circumferential position different from that of the outer mounting portion. According to this configuration, the reinforcing outer rib and the outer mounting portion are able to further effectively prevent breakage of the outer peripheral wall.

In the present invention, preferably, the supercharger preferably includes an inner mounting portion provided at the radially inner portion of the side wall of the casing and configured to connect the casing and another member, in which case the side wall rib may extend so as to be connected to the inner mounting portion. According to this configuration, since the side wall rib and the inner mounting portion receive a force caused at the time of collision, it is possible to further prevent breakage of the side wall of the casing.

In the present invention, preferably, the supercharger includes: an outer peripheral wall rib formed at the outer peripheral wall of the casing; and an inner peripheral wall rib formed at an inner peripheral wall of the casing and disposed at a circumferential position different from that of the outer peripheral wall rib, and the side wall rib includes an outer peripheral wall connection rib connected to the outer peripheral wall rib and an inner peripheral wall connection rib connected to the inner peripheral wall rib. Thus, it is possible to further prevent breakage of the side wall of the casing.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

A preferred embodiment of the present invention will now be described with reference to the accompanying drawings. The terms "left side" and "right side" in this specification are the left side and the right side as seen from a driver on a vehicle.

Figure 1:
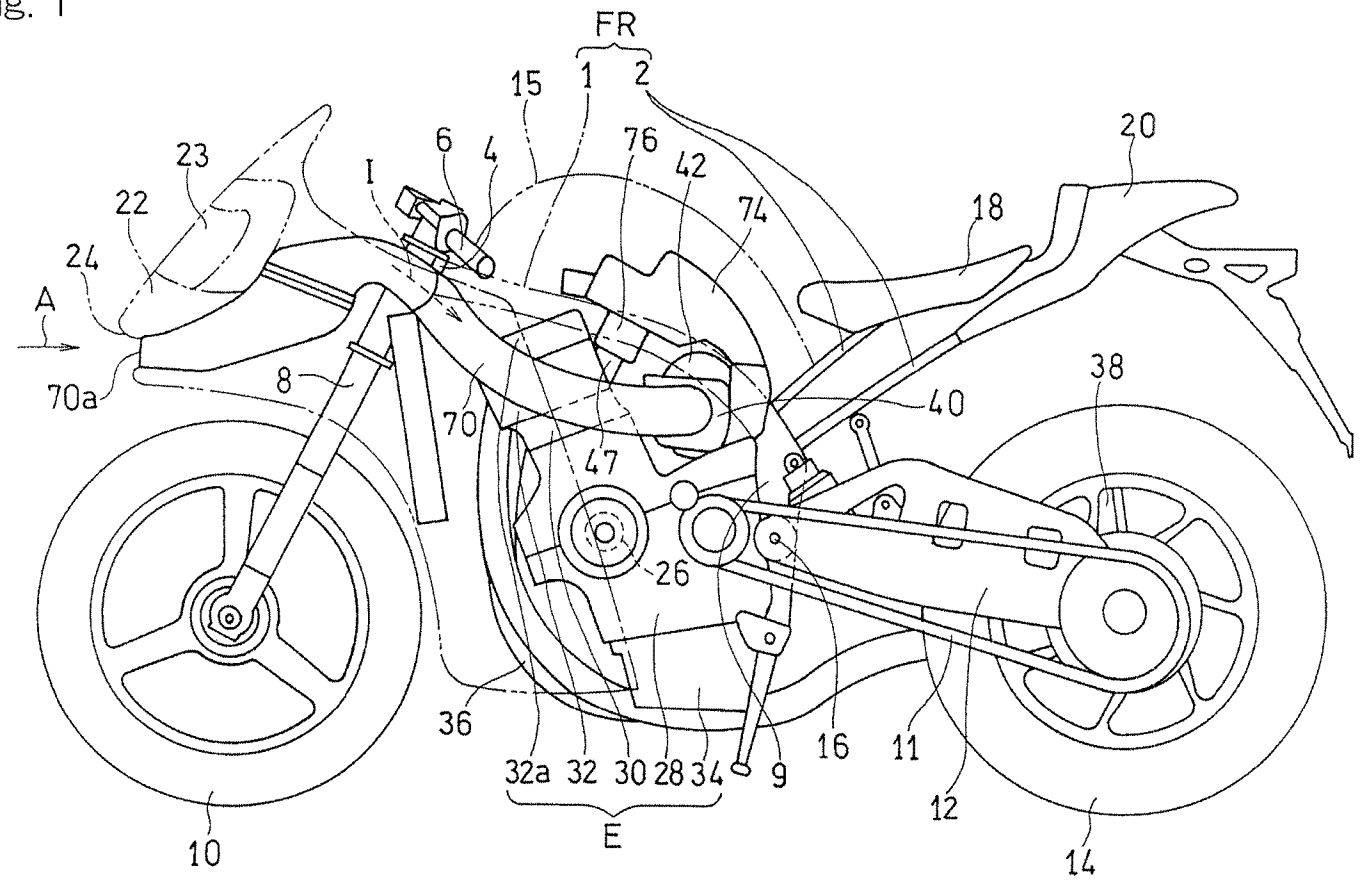
FIG. 1 is a side view showing a motorcycle equipped with a combustion engine including a supercharger according to a first preferred embodiment of the present invention.

FIG. 1 is a left side view of a motorcycle, which is one type of a saddle-riding type vehicle, including a supercharger for a combustion engine according to a first embodiment of the present invention. A motorcycle frame structure FR for the motorcycle includes a main frame 1 which forms a front half of the motorcycle frame structure FR, and a seat rail 2 which forms a rear half of the motorcycle frame structure FR. The seat rail 2 is mounted on a rear portion of the main frame 1. A head pipe 4 is integrally formed at a front end of the main frame 1, and a front fork 8 is rotatably supported by the head pipe 4 through a steering shaft (not shown). A front wheel 10 is fitted to a lower end portion of the front fork 8, and a steering handle 6 is fixed to an upper end portion of the front fork 8.

Meanwhile, a swingarm bracket 9 is provided at a rear end portion of the main frame 1, which portion is a lower intermediate portion of the motorcycle frame structure FR. A swingarm 12 is supported by the swingarm bracket 9 for swing movement in an up-down direction or vertical direction about a pivot shaft 16. A rear wheel 14 is rotatably supported by a rear end portion of the swingarm 12. A combustion engine E which is a drive source is fitted to the lower intermediate portion of the motorcycle frame structure FR at the front side of the swingarm bracket 9. This combustion engine E drives the rear wheel 14 through a power transmission mechanism 11 such as a chain. The combustion engine E is, for example, a parallel multi-cylinder water-cooled combustion engine having four cylinders with four cycles. However, the type of the combustion engine E is not limited thereto.

A fuel tank 15 is disposed on an upper portion of the main frame 1, and a rider's seat 18 and a passenger's seat 20 are supported by the seat rail 2. In addition, a fairing 22 made of a resinous material is mounted on a front portion of the motorcycle body. The fairing 22 covers a portion from front of the head pipe 4 to lateral sides of the front portion of the motorcycle body. A headlamp unit 23 is mounted on the fairing 22. Furthermore, an air inlet 24 is formed in the fairing 22. The air inlet 24 is located below the headlamp unit 23 and takes in intake air from the outside to the combustion engine E.

An air intake duct 70 is disposed at the left side of the motorcycle frame structure FR. The air intake duct 70 is supported by the head pipe 4 such that a front end opening 70*a* thereof faces the air inlet 24 of the fairing 22. The pressure of air introduced through the front end opening 70*a* of the air intake duct 70 is increased by a ram effect.

The combustion engine E includes a crankshaft 26 which extends in a right-left direction (a widthwise direction of the motorcycle), a crankcase 28 which supports the crankshaft 26, a cylinder block 30 which projects upward from an upper surface of a front portion of the crankcase 28, a cylinder head 32 above the cylinder block 30, a cylinder head cover 32*a* which covers an upper portion of the cylinder head 32, and an oil pan 34 which is provided below the crankcase 28. The cylinder block 30 and the cylinder head 32 are slightly inclined frontward. Four exhaust pipes 36 are connected to exhaust ports in a front surface of the cylinder head 32. The four exhaust pipes 36 are merged together at a location beneath the combustion engine E, and are connected to an exhaust muffler 38 which is disposed at the right side of the rear wheel 14.

A supercharger 42 and an air cleaner 40 which cleans outside air are disposed rearward of the cylinder block 30 and on an upper surface of the crankcase 28 so as to be aligned in the widthwise direction of the motorcycle. The air intake duct 70 introduces incoming wind A as intake air I from front of the combustion engine E through the left outer lateral sides of the cylinder block 30 and the cylinder head 32 into the air cleaner 40. The supercharger 42 pressurizes cleaned air from the air cleaner 40 and supplies the cleaned air to the combustion engine E.

Figure 2:
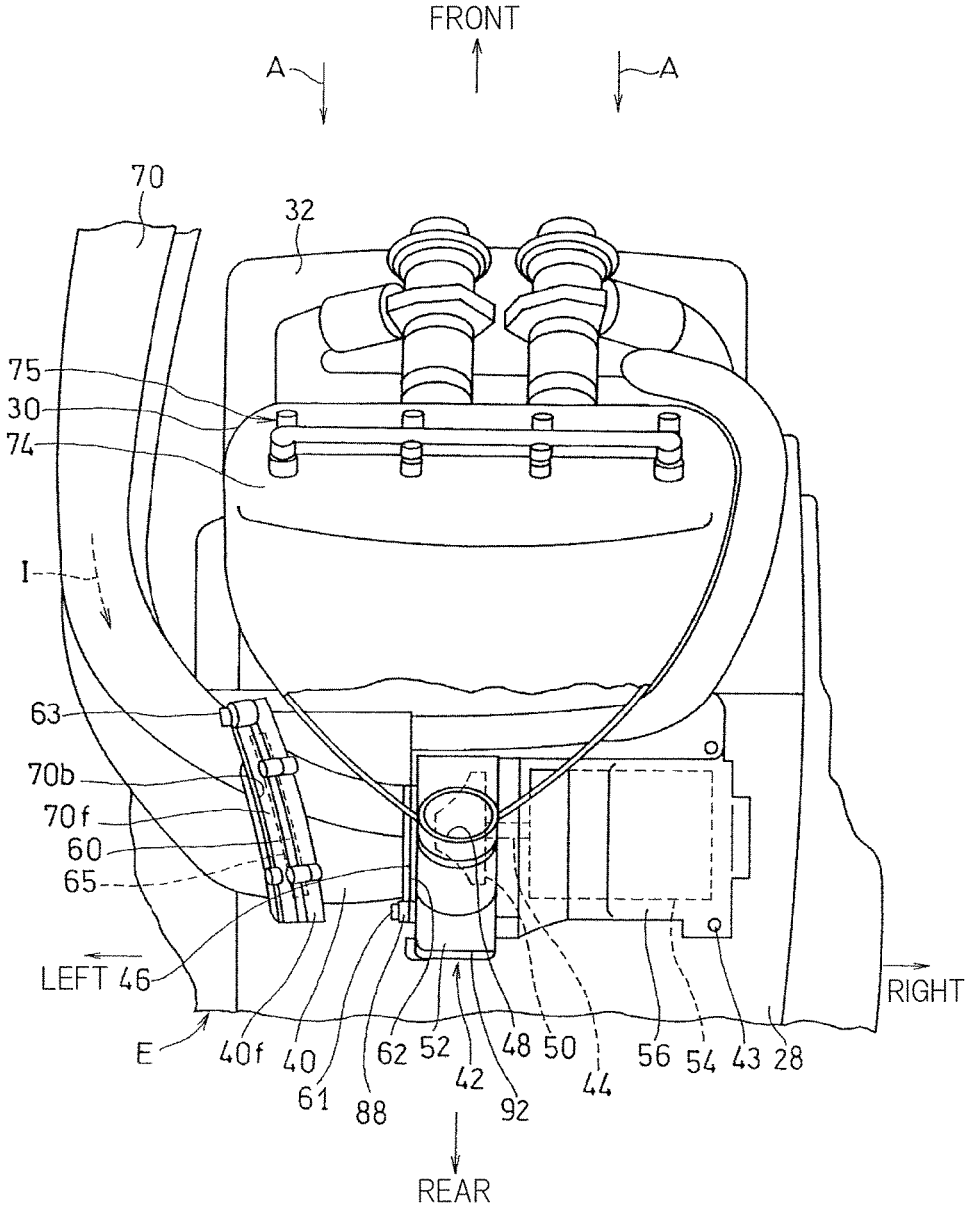
FIG. 2 is a perspective view of the combustion engine as seen from the rear and obliquely above.

As shown in FIG. 2, the supercharger 42 is disposed adjacently to and at the right side of the air cleaner 40, and includes a supercharger rotation shaft 44 extending in the widthwise direction of the motorcycle. The supercharger 42 is fixed to the upper surface of the crankcase 28 by means of a bolt or screw 43. The supercharger 42 has a suction port 46 located above the crankcase 28 and slightly leftward of a center portion of the combustion engine E in the widthwise direction, and a discharge port 48 located in the center portion of the combustion engine E in the widthwise direction of the motorcycle. The suction port 46 is opened leftward, and the discharge port 48 is opened upward.

The supercharger 42 includes a centrifugal impeller or compressor 50 which pressurizes intake air, an impeller casing 52 which covers the impeller 50, a transmission mechanism 54 which transmits power of the combustion engine E to the impeller 50, and a supercharger casing 56 which rotatably supports the supercharger rotation shaft 44. The supercharger casing 56 also covers the transmission mechanism 54. The supercharger casing 56 and the air cleaner 40 are aligned in the widthwise direction of the motorcycle with the impeller casing 52 located therebetween. Specifically, inner and outer mounting portions 88, 92 are provided to the impeller casing 52, and the supercharger casing 56 and the air cleaner 40 are connected to the impeller casing 52 by means of bolts or screws through the inner and outer mounting portions 88, 92, respectively. In other words, the impeller casing 52 is supported by the supercharger casing 56 in an axial direction, and the air cleaner 40 is supported by the impeller casing 52 in the axial direction.

The impeller casing 52 is formed in a bowl shape having openings at both sides in the axial direction, and the right opening at one side in the axial direction is formed so as to be smaller than the left opening at the other side in the axial direction. The impeller casing 52 is connected to the supercharger casing 56, whereby the right opening of the impeller casing 52 is closed, and the impeller casing 52 is connected to the air cleaner 40, whereby the left opening of the impeller casing 52 is closed.

The impeller casing 52 is connected to the air cleaner 40 and the supercharger casing 56 in the axial direction, whereby the impeller casing 52 is supported at opening portions thereof at both sides in the axial direction by the air cleaner 40 and the supercharger casing 56, and axial deformation and breakage of the impeller casing 52 are suppressed. In addition, a gap is formed between each of a left end surface and an outer peripheral surface of the impeller casing 52 and an adjacent motorcycle component.

A cleaner outlet 62 of the air cleaner 40 is connected to the suction port 46 of the supercharger 42 by means of bolts or screws 61 through the inner mounting portions 88. A rear end portion 70*b* of the air intake duct 70 is connected to a cleaner inlet 60 of the air cleaner 40 by means of a bolt or a screw 63. A cleaner element 65 which cleans outside air (intake air) I is disposed between a flange portion 70*f* of the air intake duct 70 and a flange portion 40*f* of the air cleaner 40.

As shown in FIG. 1, an air intake chamber 74 is disposed between the discharge port 48 of the supercharger 42 and air intake ports 47 of the combustion engine E, and the discharge port 48 of the supercharger 42 and the air intake chamber 74 are directly connected to each other. The air intake chamber 74 stores high-pressure intake air supplied from the discharge port 48 of the supercharger 42. The discharge port 48 of the supercharger 42 and the air intake chamber 74 may be connected to each other via a pipe.

Throttle bodies 76 are disposed between the air intake chamber 74 and the cylinder head 32. In each throttle body 76, fuel is injected from a fuel injection valve 75 (FIG. 2) into intake air to generate a fuel-air mixture, and the fuel-air mixture is supplied through the air intake port 47 to a combustion chamber (not shown) within a cylinder bore of the combustion engine E.

The air intake chamber 74 is disposed above the supercharger 42 and the throttle bodies 76 and rearward of the cylinder head 32. The air cleaner 40 is disposed below the throttle bodies 76 and between the crankcase 28 and the air intake chamber 74 in a side view. The fuel tank 15 is disposed above the air intake chamber 74 and the throttle bodies 76.

Figure 3:
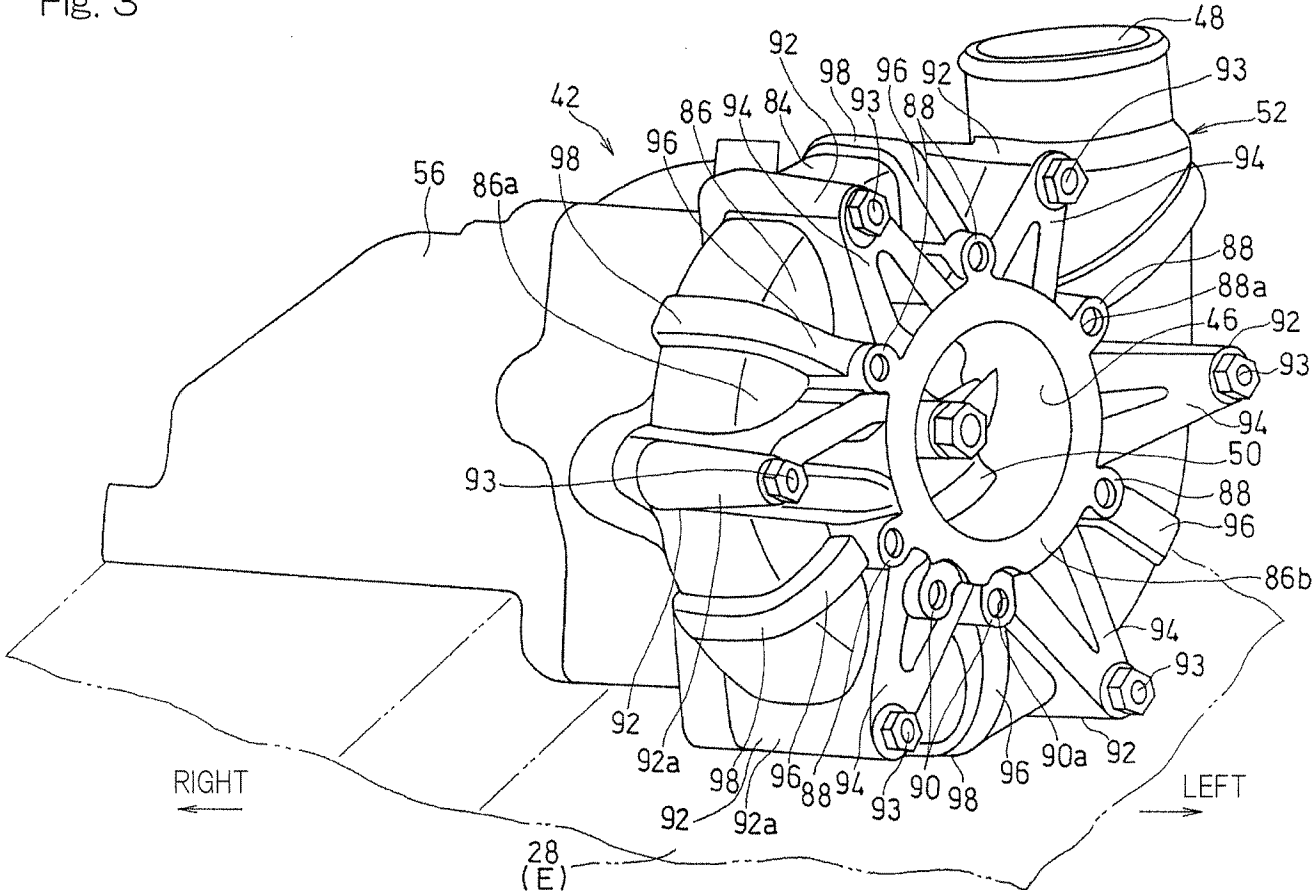
FIG. 3 is a perspective view of the supercharger as seen from the front and obliquely above.

As shown in FIG. 3, the impeller casing 52 of the supercharger 42 is provided with the suction port 46 opened leftward and the discharge port 48 opened upward. That is, the supercharger 42 is a diffuser pump which pressurizes, by the impeller 50, intake air sucked from the left side, and discharges the intake air upward.

The impeller casing 52 includes an outer peripheral wall 84 which is located radially outward of the impeller 50, and a side wall 86 which is located axially outward of the impeller 52 (at the left side thereof in the widthwise direction of the motorcycle). The outer peripheral wall 84 forms the outer peripheral surface of the impeller casing 52, and the side wall 86 forms the left end surface of the impeller casing 52.

The suction port 46 is formed in a radially inner portion of the side wall 86, and the inner mounting portions 88, which connect the impeller casing 52 and the air cleaner 40 (FIG. 2), are provided at an outer peripheral portion of the side wall 86 which is at the radially outer side of the suction port 46. In other words, the inner mounting portions 88 are provided at the radially inner portion of the side wall 86. A plurality of inner mounting portions 88, in the present preferred embodiment, five inner mounting portions 88 are disposed so as to be spaced apart from each other in a circumferential direction. However, the number of the inner mounting portions 88 is not limited thereto. Each inner mounting portion 88 has a threaded hole 88*a* facing in the widthwise direction, and the air cleaner 40 (another member) and the impeller casing 52 are connected to each other by fastening the bolt 61 into the threaded hole 88*a*. The plurality of inner mounting portions 88 are preferably formed at equal intervals in the circumferential direction.

More specifically, the side wall 86 includes a ring-shaped disc portion 86*a* which is connected to the outer peripheral wall 84 and extends radially inward from the outer peripheral wall 84, and a cylindrical tube portion 86*b* which projects from the disc portion 86*a* toward the left side which is an upstream side in a direction in which intake air flows. Thus, it is possible to reduce the thickness of the disc portion 86*a* while the inner mounting portions 88 are formed at the tube portion 86*b*. In addition, the portions of the tube portion 86*b*, at which the inner mounting portions 88 are formed, are formed so as to project further radially outward than the other portion of the tube portion 86*b*. Thus, it is possible to reduce the weight of the tube portion 86*b* as compared to the case where the radial dimension of the entire tube portion 86*b* is increased.

An inner peripheral surface of the tube portion 86*b* is formed in a shape along the outer shape of the impeller 50. Specifically, the radial dimension of the impeller 50 gradually increases from the suction port 46 toward a downstream side in the direction in which intake air flows (the axial direction). Therefore, the inner peripheral surface of the tube portion 86*b* is also formed such that the diameter dimension thereof gradually increases from the suction port 46 toward the downstream side in the direction in which intake air flows (the axial direction).

Furthermore, casing mounting portions 90 which fix the impeller casing 52 to the upper surface of the crankcase 28 are provided at an outer peripheral portion of the suction port 46 of the side wall 86 shown in FIG. 3. Two casing mounting portions 90 are provided below the suction port 46 and between the adjacent two inner mounting portions 88, 88. Each casing mounting portion 90 has a threaded hole 90*a* facing in the widthwise direction, and a mounting surface thereof is recessed rightward of the inner mounting portions 88. The impeller casing 52 is fixed to the crankcase 28 via a mounting fixture (not shown) which is connected to the casing mounting portions 90 by means of bolts or screws, thereby suppressing vibrations of the impeller casing 52. The casing mounting portions 90 may not be provided.

The outer mounting portions 92 which connect the impeller casing 52 and the supercharger casing 56 (another member) are provided at a radially outer portion of the side wall 86. A plurality of outer mounting portions 92, in the present preferred embodiment, six outer mounting portions 92 are disposed so as to be spaced apart from each other in the circumferential direction. However, the number of the outer mounting portions 92 is not limited thereto. The outer mounting portions 92 and the inner mounting portions 88 are disposed at circumferential positions different from each other. The plurality of outer mounting portions 92 are preferably formed at equal intervals in the circumferential direction.

Figure 4:
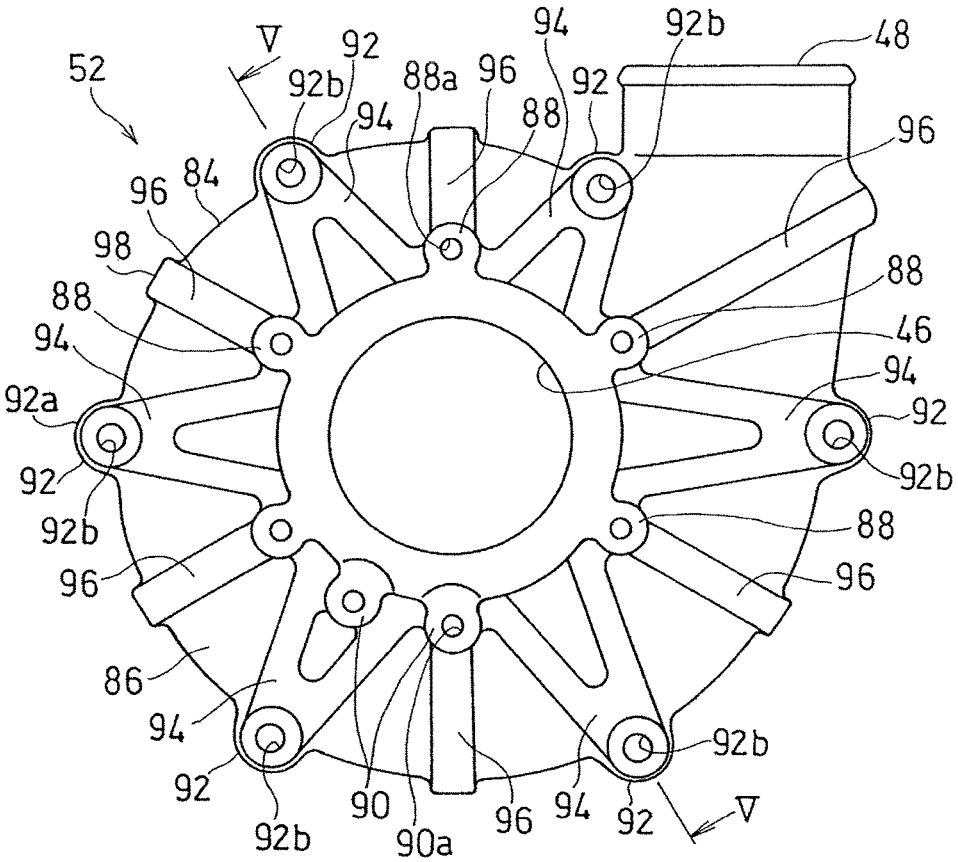
FIG. 4 is a side view of an impeller casing of the supercharger as seen from a suction side.

The outer mounting portions 92 are formed so as to project radially outward from the outer peripheral wall 84 of the impeller casing 52. Specifically, each outer mounting portion 92 includes a boss 92*a* which extends in the axial direction (the widthwise direction of the motorcycle) on the outer peripheral wall 84, and the boss 92*a* has a bolt insertion hole 92*b* (FIG. 4). A bolt 93 is inserted into the bolt insertion hole 92*b* and fastened into a threaded hole (not shown) provided in the supercharger casing 56, whereby the supercharger casing 56 and the impeller casing 52 are connected to each other. The boss 92*a* of each outer mounting portion 92 extends from one axial end of the outer peripheral wall 84 to the other axial end of the outer peripheral wall 84.

More specifically, the radial dimension of each outer mounting portion 92 is larger than the radial dimension of the outer peripheral wall 84 and the radial dimension of the disc portion 86*a* of the side wall 86. In the present preferred embodiment, the outer peripheral wall 84 is formed to have substantially the same thickness as that of the disc portion 86*a* of the side wall 86. The outer peripheral wall 84 is formed such that the radial dimension thereof is substantially the same as the radial dimension of the disc portion 86*a* of the side wall 86. In addition, since the outer mounting portions 92 are disposed so as to be spaced apart from each other in the circumferential direction, it is possible to prevent radial deformation and breakage of the outer peripheral wall 84 without excessively increasing the thickness of the outer peripheral wall 84.

The outer peripheral wall 84 of the impeller casing 52 is reinforced by the bosses 92*a* of the outer mounting portions 92, whereby radial deformation of the impeller casing 52 is suppressed. That is, each boss 92*a* also serves as a part of an outer peripheral wall rib (a first outer peripheral wall rib 92*a*). In addition, each inner mounting portion 88 also serves as an inner peripheral wall rib.

As shown in FIG. 4, first side wall ribs 94 are formed at the side wall 86 so as to extend substantially radially from the respective outer mounting portions 92 toward the suction port 46. That is, each first side wall rib 94 extends from the radially inner portion of the side wall 86 to the radially outer portion of the side wall 86 (to the outer mounting portion 92). Each first side wall rib 94 is formed so as to project axially outward (leftward) from the side wall 86 of the impeller casing 52 to suppress axial deformation of the side wall 86. In the present preferred embodiment, each first side wall rib 94 is formed in a V-shape with the outer mounting portion 92 as a base or an intersection. Since each first side wall rib 94 is formed in a V-shape as described above, it is possible to reduce the number of ribs, and a reinforcing effect improves.

Furthermore, second side wall ribs 96 are formed at the side wall 86 so as to extend radially from the respective inner mounting portions 88 toward the outer peripheral wall 84. That is, each second side wall rib 96 also extends from the radially inner portion of the side wall 86 (the inner mounting portion 88) toward the radially outer portion of the side wall 86, and is formed so as to project axially outward (leftward) from the side wall 86. In the present preferred embodiment, in addition, the second side wall rib 96 extends from the casing mounting portion 90 toward the outer peripheral wall 84. Six second side wall ribs 96 are formed so as to be spaced apart from each other in the circumferential direction. The first side wall ribs 94 and the second side wall ribs 96 are disposed so as to alternate with each other in the circumferential direction to reinforce the side wall 86.

Each of the side wall ribs 94, 96 is formed such that the axial dimension thereof is larger than the axial dimension of the side wall 86. Specifically, each of the side wall ribs 94, 96 is formed so as to project axially from the side wall 86 by a projection amount equal to or smaller than a projection amount by which the tube portion 86*b* of the side wall 86 projects axially from the disc portion 86*a*. For example, each first side wall rib 94 is formed such that an axial projection amount thereof is larger than that of each second side wall rib 96. Since each of the side wall ribs 94, 96 is formed such that the projection amount thereof is equal to or smaller than that of the tube portion 86*b*, each rib is easily formed by molding and cutting.

As shown in FIG. 3, each second side wall rib 96 bends axially (rightward) at a radially outer end and extends axially (rightward) on the outer peripheral wall 84 to form a second outer peripheral wall rib 98. That is, each second side wall rib 96 extends from the radially inner portion of the side wall 86 to the second outer peripheral wall rib 98. The height (the axial projection amount) and the width (circumferential dimension) of each first side wall rib 94 are set larger than those of each second side wall rib 96. Each second outer peripheral wall rib 98 has no bolt hole and is formed so as to be smaller in size than each first outer peripheral wall rib 92*a*.

As shown in FIG. 4, each second outer peripheral wall rib 98 is also formed so as to project radially outward from the outer peripheral wall 84, and is disposed at a circumferential position different from that of each outer mounting portion 92. Specifically, the first and second outer peripheral wall ribs 92*a*, 98 are disposed so as to alternate with each other in the circumferential direction. The height (radial projection amount) and the width (circumferential dimension) of each first outer peripheral wall rib (boss) 92*a* are set larger than those of each second outer peripheral wall rib 98.

Each of the reinforcing ribs 92*a*, 94, 96, and 98 described above is formed integrally with the impeller casing 52 by molding. In the present preferred embodiment, the impeller casing 52 and each of the reinforcing ribs 92*a*, 94, 96, and 98 are made from an aluminum alloy. Since such reinforcing ribs 92*a*, 94, 96, and 98 are provided at the impeller casing 52, the surface area increases, and as a result, heat dissipation of the impeller casing 52 improves. However, the material of the impeller casing 52 is not limited to the aluminum alloy, and may be, for example, another metal or a resin. In the case where a resin is used, the resin preferably contains a reinforcing material such as glass fibers or carbon fibers. In addition, the reinforcing ribs and the impeller casing may be provided as separate members. In this case, the reinforcing ribs and the impeller casing may be formed from different materials.

When the motorcycle shown in FIG. 1 runs, the incoming wind A is introduced as the intake air I through the air inlet 24 into the air intake duct 70. The intake air I flows rearward within the air intake duct 70, and is introduced into the air cleaner 40 while changing the direction thereof to an inward direction in the widthwise direction of the motorcycle.

The intake air I introduced into the air cleaner 40 is cleaned by the cleaner element 65 shown in FIG. 2 and introduced through an air intake passage IP within the air cleaner 40 into the supercharger 42. The intake air I pressurized into the supercharger 42 is increased by the impeller 50, and then the intake air I so pressurized is discharged through the discharge port 48. The high-pressure intake air I discharged from the supercharger 42 is introduced into the air intake chamber 74 shown in FIG. 1 and then supplied through the throttle bodies 76 to the air intake ports 47 of the combustion engine E.

Figure 5:
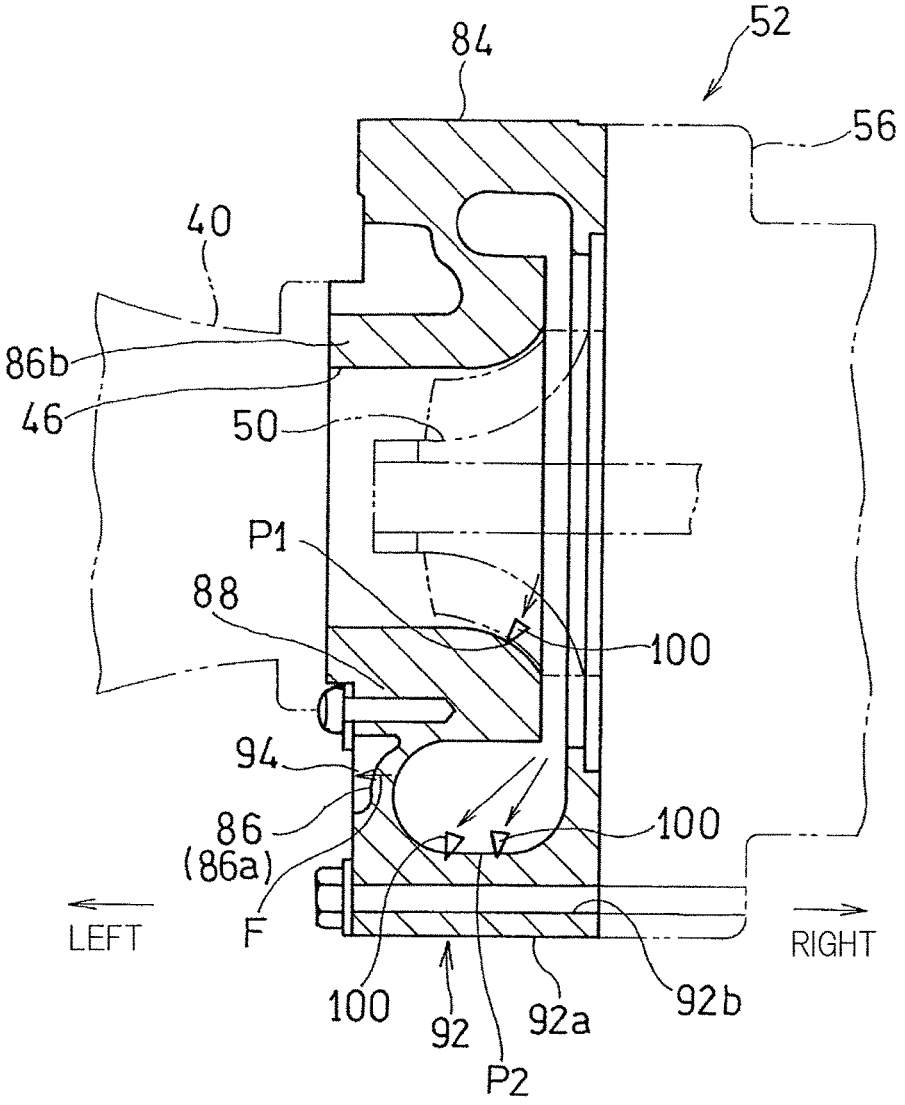
FIG. 5 is a cross-sectional view taken along a V-V line in FIG. 4.

The disc portion 86*a* of the side wall 86 and the outer peripheral wall 84 are preferably formed such that the thicknesses thereof are small for weight reduction. However, as the thickness is reduced, each wall is more easily broken. During rotation of the supercharger 42 at a high speed, the impeller 50 may be broken to cause broken pieces thereof. In addition, small pieces may enter the air intake passage. As shown in FIG. 5, due to a centrifugal force caused by rotation of the supercharger 42 at a high speed, broken pieces or small pieces 100 collide against a portion P1 of the impeller casing 52 which faces the radially outer side of the impeller 50.

In addition, in the case of collision against an outer peripheral wall inner surface P2 of the impeller casing 52, since the outer peripheral wall ribs 92*a* are formed as described above, it is possible to prevent deformation of a thin portion of the outer peripheral wall 84 to prevent breakage of the outer peripheral wall 84. Furthermore, in the case of collision against the inner peripheral surface of the tube portion 86*b* of the impeller casing 52, radial deformation of the inner wall is suppressed since the inner peripheral wall ribs 88 are formed. Also, a force caused by the collision is changed in direction and transmitted as a force which moves the tube portion 86*b* toward the suction port 46, since the inner peripheral surface is inclined such that the diameter thereof increases from the suction port 46 toward the downstream side (right side). That is, each broken piece 100 serves as a wedge which widens a gap between the tube portion 86*b* and the impeller 50. Thus, the disc portion 86*a* of the side wall 86 which has a relatively small thickness receives a force F in the axial direction.

In the above configuration, since the side wall ribs 94, 96 are formed at the side wall 86 as described above, it is possible to prevent deformation of the thin disc portion 86*a* of the side wall 86 to prevent breakage of the side wall 86. Since the side wall ribs 94, 96 are formed as described above, it is possible to prevent breakage of the impeller casing 52 without excessively increasing the thickness of the impeller casing 52.

Since the side wall ribs 94, 96 extend in the radial direction, it is possible to extend, in the radial direction, a portion of the side wall 86, which portion has a high axial strength. As a result, even if a force caused when the broken piece 100 collides against the impeller casing 52 is transmitted from the collision portion of the impeller casing 52 in a direction different from the radial direction, it is possible to effectively prevent radial deformation of the side wall 86. Furthermore, since the side wall ribs 94, 96 extend from the radially inner portion of the side wall 86 to the radially outer portion of the side wall 86, it is possible to extend, over the entire area in the radial direction, the portion of the side wall 86, which portion has a high axial strength.

In addition, since a force, from the collision portion of the impeller casing 52, caused at the time of collision against the impeller casing 52 is received by the outer peripheral wall ribs 92*a*, 98, it is possible to prevent breakage of the outer peripheral wall 84. Even if the direction of the force caused at the time of collision is changed to the axial direction due to the force caused at the time of collision being received by the outer peripheral wall ribs 92*a*, 98, the side wall ribs 94, 96 are formed also at the side wall 86 as described above, and therefore, it is possible to prevent breakage of the side wall 86.

Since the side wall ribs 94, 96 extend so as to be connected to the outer peripheral wall ribs 92*a*, 98, respectively, a force caused at the time of collision is received by the side wall ribs 94, 96 and the outer peripheral wall ribs 92*a*, 98. Therefore, it is possible to further effectively prevent breakage of the impeller casing 52.

Since the pluralities of the outer peripheral wall ribs 92*a*, 98 are formed so as to project radially outward from the outer peripheral wall 84 and are spaced apart from each other in the circumferential direction, it is possible to further prevent breakage of the impeller casing 52. In addition, the radial thickness of the impeller casing 52 is reduced at a portion where no outer peripheral wall ribs 92*a*, 98 are provided, and thus it is possible to reduce the weight of the impeller casing 52.

Since each first outer peripheral wall rib 92*a* also serves as the outer mounting portion 92 which connects the impeller casing 52 and the supercharger casing 56, it is possible to prevent breakage of the impeller casing 52 while the weight of the impeller casing 52 is reduced.

Since the outer peripheral wall ribs 92*a*, 98 are composed of the first and second outer peripheral wall ribs 92*a*, 98, it is possible to further effectively prevent breakage of the outer peripheral wall 84.

Since each second outer peripheral wall rib 98 extends so as to be connected to the inner mounting portion 88, a force caused at the time of collision is received by each second outer peripheral wall rib 98 and each inner mounting portion 88, and thus it is possible to further prevent breakage of the side wall 86.

Since each first side wall rib 94 is connected to the first outer peripheral wall rib 92*a* and each second side wall rib 96 is connected to the inner mounting portion 88, it is possible to further effectively prevent breakage of the side wall 86.

In the supercharger 42 of the present preferred embodiment, since the side wall ribs 94, 96 are disposed so as to be spaced apart from each other in the circumferential direction, there is the possibility that slight deformation, crack, or the like occurs in the thin portion of the side wall 86, but slight deformation, crack, or the like which does not influence the function of the supercharger 42 is allowed. Since the thin portion is left as described above, it is possible to reduce the weight of the supercharger 42 while slight deformation is allowed. As long as deformation of the impeller casing 52 is maintained within such an allowable range, the outer peripheral wall ribs 92*a*, 98 may not be provided, and either of the first and second side wall ribs 94, 96 may be dispensed with.

The present invention is not limited to the embodiment described above, and various additions, modifications, or deletions may be made without departing from the gist of the invention. For example, in the preferred embodiment described above, the side wall ribs and the outer peripheral wall ribs are provided, but at least the side wall ribs only need to be provided. In addition, each side wall rib 94 in the preferred embodiment extends from the radially inner portion of the impeller casing 52 to the radially outer portion of the impeller casing 52, but only needs to extend radially from at least one of the radially inner portion and the radially outer portion.

The supercharger of the present invention is suitably applied to a centrifugal type supercharger including an impeller which is rotationally driven at a relatively high speed. In addition, the supercharger of the present invention is suitably applied to a supercharger whose speed is increased by a planetary gear device. In the case where power is obtained from a combustion engine to rotationally drive the impeller, variation in rotation is likely to occur, and breakage of the impeller caused due to the variation in rotation may occur. However, by applying the rib structure of the present invention, it is possible to suitably prevent breakage of the impeller casing. It should be noted that the supercharger of the present invention is also applicable to a supercharger which is driven by exhaust energy, an electric motor, or the like other than combustion engine power.

A side wall rib which does not extend in the radial direction is also included with the present invention. For example, the side wall rib may extend in the circumferential direction, may be formed in a polka dot (dotted) pattern, or may be formed in a helical shape. In the preferred embodiment described above, the structure has been described in which the side wall ribs are connected to the inner peripheral wall ribs and the outer peripheral wall ribs, but the side wall ribs may not be connected to the outer peripheral wall ribs and the inner peripheral wall ribs.

Since the supercharger of the present invention is able to prevent breakage of the impeller casing, a housing which further covers the impeller casing may be omitted, or the strength of such a housing may be decreased. Thus, the supercharger of the present invention is suitably applied to a vehicle including an exposed combustion engine, such as a motorcycle. Furthermore, the supercharger of the present invention is also applicable to a combustion engine of a saddle-riding type vehicle other than a motorcycle, for example, applicable to a three-wheeled vehicle and a four-wheeled vehicle. Therefore, this is construed as included within the scope of the present invention.

REFERENCE NUMERALS

40 . . . air cleaner (another member)
42 . . . supercharger
50 . . . impeller
52 . . . impeller casing (casing)
56 . . . supercharger casing (another member)
84 . . . outer peripheral wall
86 . . . side wall
88 . . . inner mounting portion (inner peripheral wall rib)
92 . . . outer mounting portion
92*a* . . . boss (first outer peripheral wall rib)
94 . . . first side wall rib
96 . . . second side wall rib
98 . . . second outer peripheral wall rib
E . . . combustion engine

What is claimed is:

1. A supercharger which pressurizes intake air for a combustion engine of a saddle-riding vehicle, the supercharger comprising:

a supercharger casing;

a centrifugal impeller;

an impeller casing including:

an outer peripheral wall located radially outward from the centrifugal impeller and a side wall located axially outward of the centrifugal impeller, the impeller casing covering the centrifugal impeller;

a first side wall rib provided at an outbound surface of the side wall and the side wall further provided with a suction port of the supercharger; and an outer peripheral wall rib formed at an outbound surface of the outer peripheral wall, wherein the first side wall rib extends radially along the outer surface of the side wall so as to transitionally connect to the outer peripheral wall rib extending axially along the outer surface of the outer peripheral wall, and the outer peripheral wall rib has an outer mounting portion into which a fastener is received in a manner that connects the impeller casing to the supercharger casing, and the outer mounting portion extends from one axial end to the other axial end of the outer peripheral wall.

2. The supercharger as claimed in claim 1, wherein the first side wall rib extends from a radially inner portion of the side wall to a radially outer portion of the side wall, and is formed in a V-shape with the outer mounting portion as a base.

3. The supercharger as claimed in claim 1, further comprising an inner mounting portion provided at the radially inner portion of the side wall of the impeller casing and configured to connect the impeller casing and an air cleaner member, wherein the first side wall rib extends so as to be connected to the inner mounting portion.

4. The supercharger as claimed in claim 1, wherein a plurality of the first side wall ribs are formed so as to be spaced apart from each other in a circumferential direction and are formed in a V-shape as viewed in an axial direction.

5. The supercharger as claimed in claim 1, wherein the outer mounting portion includes a boss which extends in the axial direction on the outer peripheral wall, and the boss has a bolt insertion hole therein, into which a bolt is inserted.

6. The supercharger as claimed in claim 1, further comprising:

a transmission mechanism being disposed in the supercharger casing, the transmission mechanism transmitting power supplied from the combustion engine to the centrifugal impeller; and a supercharger rotation shaft is disposed along a longitudinal axis and which connects the transmission mechanism to the centrifugal impeller; wherein at least two first side wall ribs are provided, and the at least two first side wall ribs are connected together to form a V-shape on an outer peripheral wall of the impeller casing as viewed in an axial direction toward the impeller casing from a position along the longitudinal axis external to the impeller casing.

7. The supercharger as claimed in claim 6 further comprising an air cleaner mounted on the impeller casing adjacent the supercharger casing, which air cleaner cleans outside air.

8. The supercharger as claimed in claim 6, wherein the vehicle is a motorcycle.

9. A supercharger which pressurizes intake air for a combustion engine of a saddle-riding vehicle, the supercharger comprising:

a supercharger casing;

a centrifugal impeller;

an impeller casing including;

an outer peripheral wall located radially outward of the centrifugal impeller and a side wall located axially outward of the centrifugal impeller, the impeller casing covering the centrifugal impeller;

a first side wall rib is provided at an outbound surface of the side wall and the side wall is further provided with a suction port of the supercharger;

the outer peripheral wall rib is formed at an outbound surface of the outer peripheral wall;

an inner mounting portion is provided at the radially inner portion of the side wall of the casing and is configured to connect the casing and an air cleaner; and a second side wall rib provided at the side wall of the impeller casing, which side wall is provided with the suction port of the supercharger, the second side wall rib extending radially, wherein the first side wall rib extends radially along the outer surface of the side wall so as to be transitionally connected to the outer peripheral wall rib extending axially along the outer surface of the outer peripheral wall, the outer peripheral wall rib has an outer mounting portion into which a fastener is received in a manner that connects the impeller casing to the supercharger casing, the first side wall rib extends so as to be connected to the inner mounting portion, and the second side wall rib extends so as to be connected to the inner mounting portion.

10. The supercharger as claimed in claim 9, wherein the inner mounting portion is disposed at a circumferential position different from that of the outer mounting portion.

11. The supercharger as claimed in claim 9, wherein the first side wall rib extends from a radially inner portion of the side wall to a radially outer portion of the side wall, and is formed in a V-shape with the outer mounting portion as a base.

12. The supercharger as claimed in claim 9, wherein a plurality of the first side wall ribs are formed so as to be spaced apart from each other in a circumferential direction and are formed in a V-shape as viewed in an axial direction.

13. The supercharger as claimed in claim 9, further comprising:

a transmission mechanism being disposed in the supercharger casing, the transmission mechanism transmitting power supplied from the combustion engine to the centrifugal impeller; and a supercharger rotation shaft disposed along a longitudinal axis and which connects the transmission mechanism to the centrifugal impeller, wherein at least two first side wall ribs are provided, and the at least two first side wall ribs are connected together to form a V-shape as viewed in an axial direction toward the impeller casing from a position along the longitudinal axis external to the impeller casing.

14. A supercharger which pressurizes intake air for a combustion engine of a saddle-riding vehicle, the supercharger comprising:

a supercharger casing;

a centrifugal impeller;

an impeller casing including:

an outer peripheral wall located radially outward of the centrifugal impeller and a side wall located axially outward of the centrifugal impeller, the impeller casing covering the centrifugal impeller;

a first side wall rib provided at an outbound surface of the side wall and the side wall is further provided with a suction port of the supercharger; and an outer peripheral wall rib is formed at an outbound surface of the outer peripheral wall, wherein the first side wall rib extends radially along the outer surface of the side wall so as to be transitionally connected to the outer peripheral wall rib extending axially along the outer surface of the outer peripheral wall, the outer peripheral wall rib has an outer mounting portion into which a fastener is received in a manner that connects the impeller casing to the supercharger casing, and a plurality of outer peripheral wall ribs extend on an outer peripheral wall of the impeller casing and a plurality of side wall ribs extend in an axial dimension further than the axial dimensions of the side wall of the impeller casing.

15. The supercharger as claimed in claim 14, wherein the outer peripheral wall ribs are spaced around the impeller casing and the side wall ribs are spaced around the side wall.

16. The supercharger as claimed in claim 14, wherein the first side wall rib extends from a radially inner portion of the side wall to a radially outer portion of the side wall, and is formed in a V-shape with the outer mounting portion as a base.

17. The supercharger as claimed in claim 14, wherein a plurality of the first side wall ribs are formed so as to be spaced apart from each other in a circumferential direction and are formed in a V-shape as viewed in an axial direction.

18. The supercharger as claimed in claim 14, further comprising:

a transmission mechanism being disposed in the supercharger casing, the transmission mechanism transmitting power supplied from the combustion engine to the centrifugal impeller; and a supercharger rotation shaft disposed along a longitudinal axis and connects the transmission mechanism to the centrifugal impeller, wherein at least two first side wall ribs are provided, and the at least two first side wall ribs are connected together to form a V-shape as viewed in an axial direction toward the impeller casing from a position along the longitudinal axis external to the impeller casing.

* * * * *